United States Patent [19]

Dankworth

[11] Patent Number: 4,483,225

[45] Date of Patent: Nov. 20, 1984

[54] METHOD FOR REMOVING DAMAGED ENDS FROM BALES

[76] Inventor: Ralph L. Dankworth, 4546 W. Crivello, Laveen, Ariz. 85339

[21] Appl. No.: 450,360

[22] Filed: Dec. 16, 1982

[51] Int. Cl.[3] ..... B26D 7/06

[52] U.S. Cl. ..... 83/13; 83/409; 83/415; 83/435.1; 241/101 A

[58] Field of Search ..... 83/435.1, 415, 437, 83/13, 409, 409.1, 451, 452; 241/101 A

[56] References Cited

U.S. PATENT DOCUMENTS

| | | | |
|---|---|---|---|
| 125,975 | 4/1872 | Morehous | 83/435.1 X |
| 362,410 | 5/1887 | Williams et al. | 83/435.1 |
| 729,915 | 6/1903 | Beecher | 83/415 |
| 918,152 | 4/1909 | Hodgen | 83/435.1 X |
| 1,741,753 | 12/1929 | Ast | 83/415 X |
| 2,438,610 | 3/1948 | Lambert | 83/409 |
| 2,822,006 | 2/1958 | Anderegg et al. | 83/435.1 X |
| 4,194,269 | 3/1980 | Reiche et al. | 241/101 A X |

FOREIGN PATENT DOCUMENTS

| | | | |
|---|---|---|---|
| 528821 | 8/1956 | Canada | 241/101 A |

*Primary Examiner*—Frank T. Yost

*Attorney, Agent, or Firm*—Brown, Martin & Haller

[57] ABSTRACT

A movable trolley is positioned on a track and includes a platform. A bale of fibrous material is positioned on the platform and backed in position by an adjustable backing plate. Holding straps retain the bale in position on the platform as the trolley is moved past a cutting member to cut off the damaged end of the bale.

6 Claims, 4 Drawing Figures

METHOD FOR REMOVING DAMAGED ENDS FROM BALES

BACKGROUND OF THE INVENTION

The present invention relates to a method and apparatus for removing the damaged ends from fibrous bales such as cotton bales for example.

Bales of fibrous material such as cotton are normally stored on end. Very often the end that is positioned on the ground or on the floor becomes water soaked. The conventional way of solving this problem is to manually pick off or cut off the damaged ends. This is laborious and time consuming. Such procedure also adds considerable cost to the bale.

It is an object of the present invention to provide a new and improved method and apparatus for removing the damaged end of a bale of fibrous material that is rapid and easy.

It is another object of the present invention to provide a new and improved method and apparatus for removing the damaged end of a bale of fibrous material that reduces the cost of such removal.

SUMMARY OF THE INVENTION

The shortcomings of the prior method of handling the problem are avoided and the above objectives are attained by apparatus including means for feeding and positioning the bale to a location where it is secured by securing means and moving means for moving the bale past a cutting means which removes the damaged end.

DETAILED DESCRIPTION OF THE INVENTION

Figure 1:
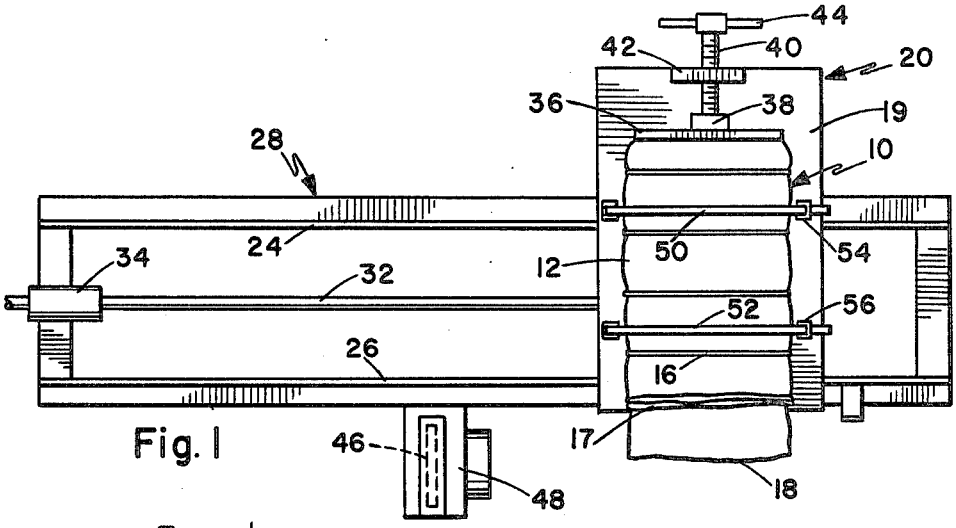
FIG. 1 is a top plan view of the apparatus of the present invention.
Figure 2:
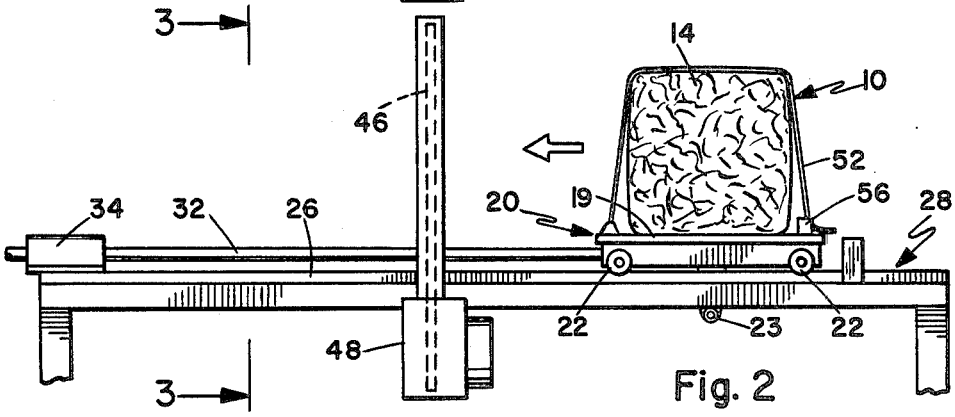
FIG. 2 is a front elevation view of the apparatus shown in FIG. 1.
Figure 3:
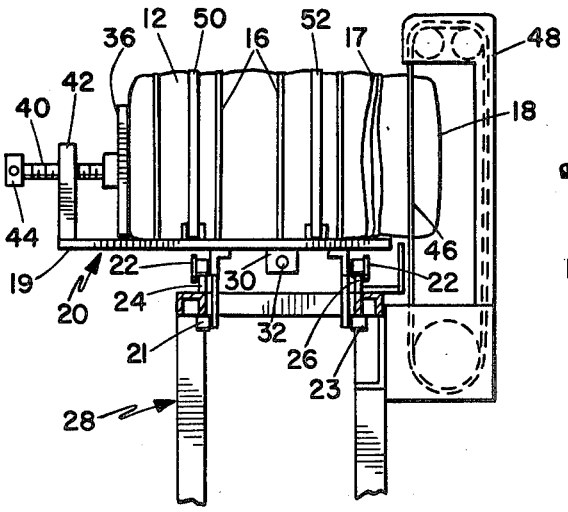
FIG. 3 is a sectional view taken on line 3—3 of FIG. 2.

A bale 10 of fibrous material such as cotton is shown in the drawings. The bale 10 includes a package or wrapper 12 which encloses the fibrous material 14, and a plurality of straps 16 on the bale to hold it in the compressed condition. The bale 10 shows a damaged end 18 which has been subjected to water and has become unacceptable for use. The end 17 of the wrapper 12 is opened and peeled back away from the damaged end 18 of the bale. The bale 10 is positioned on the platform 19 of a trolley 20 having wheels 22 that travel on tracks 24 and 26 supported on frame 28. Retaining wheels 21 and 23 are positioned on brackets extending from the bottom of the trolley 20 and ride on frame 28. The trolley 20 is connected through a bracket 30 on the bottom of platform 19 to a push-pull rod 32. The push-pull rod 32 passes through guide 34 and connects to an actuating means (not shown) such as a hydraulic cylinder, a lead screw-electric motor combination or any other suitable device for moving the push-pull rod 32 back and forth. The actuating means is actuated by the usual switch arrangement.

The bale 10 of fibrous material is placed on the platform 19 of trolley 20 and is positioned on the platform 19 with the back plate 36 for proper cutting. The back plate 36 has a receptacle 38 which sheets the end of screw member 40. The screw member 40 is in threaded engagement with bracket 42 and includes handle 44. Thus, as handle 44 is turned in one direction or the other, the back plate 36 is moved toward the front or the rear of the trolley platform 19. The bale 10 is adjusted on the trolley platform 19 so that the back portion of the damaged end 18 of the bale 10 is lined up with the blade 46 of band saw 48. The bale 10 is then held in position on the trolley platform 19 by straps 50 and 52. These straps are shown as flexible rubber straps that connect to quick connect buckles 54 and 56 on trolley platform 19. They could also be elastic cords with hook and eye connections or other suitable arrangements.

Once the bale 10 is positioned and strapped to the trolley platform 19, the actuator (not shown) moves the push-pull rod 32 past the band saw 48 and the damaged end 18 is cut off the bale 10 by the blade 46. The end 17 of the wrapper 12 is then pulled around the end of the bale 10 and reclosed. The straps 50 and 52 are removed from around the bale 10 and the bale is taken off the trolley platform 19. The trolley 20 is moved back to the loading position by the actuator (not shown).

Figure 4:
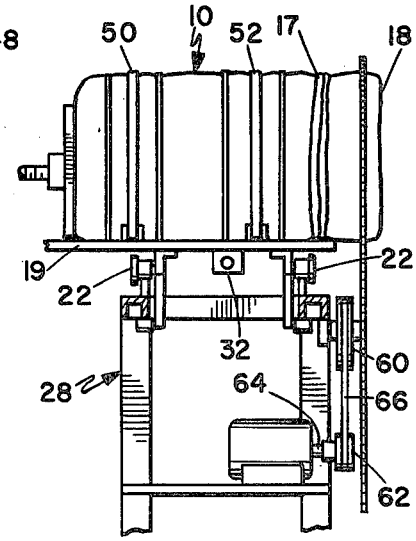
FIG. 4 is a view similar to FIG. 3 showing an alternative circular saw arrangement.

An alternate form of saw is shown in FIG. 4 of the drawings. A circular saw blade 58 is connected to a pulley 60 which is coupled with pulley 62 on electric motor shaft 64 with the V-belt 56.

The apparatus of the present invention renders it economically feasible to reclaim damaged bales and reduces the cost of producing baled products.

Having thus described my invention, I claim:

1. The method of removing the damaged end from a covered bale of fibrous material comprising the steps of:

opening the bale cover;

positioning the bale in the proper location for cutting to remove just the damaged end;

automatically moving the bale to a cutting location;

automatically removing the damaged end from the bale; and closing the bale cover.

2. The method of removing the damaged end from a covered bale of fiberous material according to claim 1 wherein:

the step of positioning the bale comprises positioning the bale on a platform of movable trolley that is mounted for movement on a frame.

3. The method of removing the damaged end from a covered bale of fiberous materials according to claim 2 wherein:

the step of automatically moving the bale to a cutting location comprises moving the trolley to a position for engaging cutting means.

4. The method of removing the damaged end from a covered bale of fiberous material according to claim 2 wherein:

the step of automatically removing the damaged end from the bale comprises moving the bale into engagement with a cutting blade.

5. The method of removing the damaged end from a covered bale of fiberous material according to claim 4 wherein:

the cutting means includes a serrated blade.

6. The method of removing the damaged end from a covered bale of fiberous material according to claim 4 wherein:

the cutting means is a band saw blade.

* * * * *